US009207644B2

(12) United States Patent
Bazin et al.

(10) Patent No.: US 9,207,644 B2
(45) Date of Patent: Dec. 8, 2015

(54) METHOD OF MANUFACTURING A WATCH PLATE

(75) Inventors: Jean-Luc Bazin, Publier (FR); Stewes Bourban, Cudrefin (CH); Yves Winkler, Schmitten (CH); Joachim Grupp, Enges (CH); Nathalie Brebner-Grupp, legal representative, Enges (CH)

(73) Assignee: The Swatch Group Research and Development Ltd, Marin (CH)

( * ) Notice: Subject to any disclaimer, the term of this patent is extended or adjusted under 35 U.S.C. 154(b) by 1209 days.

(21) Appl. No.: 13/124,975

(22) PCT Filed: Oct. 21, 2009

(86) PCT No.: PCT/EP2009/063782

§ 371 (c)(1), (2), (4) Date: Oct. 6, 2011

(87) PCT Pub. No.: WO2010/046381

PCT Pub. Date: Apr. 29, 2010

(65) Prior Publication Data

US 2012/0024432 A1 Feb. 2, 2012

(30) Foreign Application Priority Data

Oct. 21, 2008 (EP) ..... 08167196

(51) Int. Cl.

| | |
|---|---|
| ***G04B 29/02*** | (2006.01) |
| ***C22F 1/00*** | (2006.01) |
| ***B21J 1/00*** | (2006.01) |

(52) U.S. Cl.
CPC ..... *G04B 29/027* (2013.01); *B21J 1/006* (2013.01); *C22F 1/00* (2013.01)

(58) Field of Classification Search
CPC ..... C22F 1/00; G04B 29/027
USPC ..... 148/516, 522, 527; 968/266–269, 280
See application file for complete search history.

(56) References Cited

FOREIGN PATENT DOCUMENTS

| | | | |
|---|---|---|---|
| EP | 1 696 153 | A1 | 8/2006 |
| JP | 55-145139 | A | 11/1980 |
| JP | 2001-293551 | A | 10/2001 |
| JP | 2005-201789 | A | 7/2005 |
| WO | 2004/047582 | A2 | 6/2004 |

OTHER PUBLICATIONS

English language machine translation of JP 2005201789 to Hirasawa et al. Generated Mar. 4, 2015.*

* cited by examiner

*Primary Examiner* — Brian Walck
(74) *Attorney, Agent, or Firm* — Sughrue Mion, PLLC

(57) ABSTRACT

The present invention relates to a method of making a timepiece plate. This method is characterized in that it includes the following steps:

a) taking ($A_1$, $A_2$) the material forming the plate including at least one metallic element;
b) forming ($B_1$, $B_2$) the plate;
c) cooling (C) everything so as to obtain the timepiece plate in an at least partially amorphous state; and
d) retrieving (D) the plate.

48 Claims, 1 Drawing Sheet

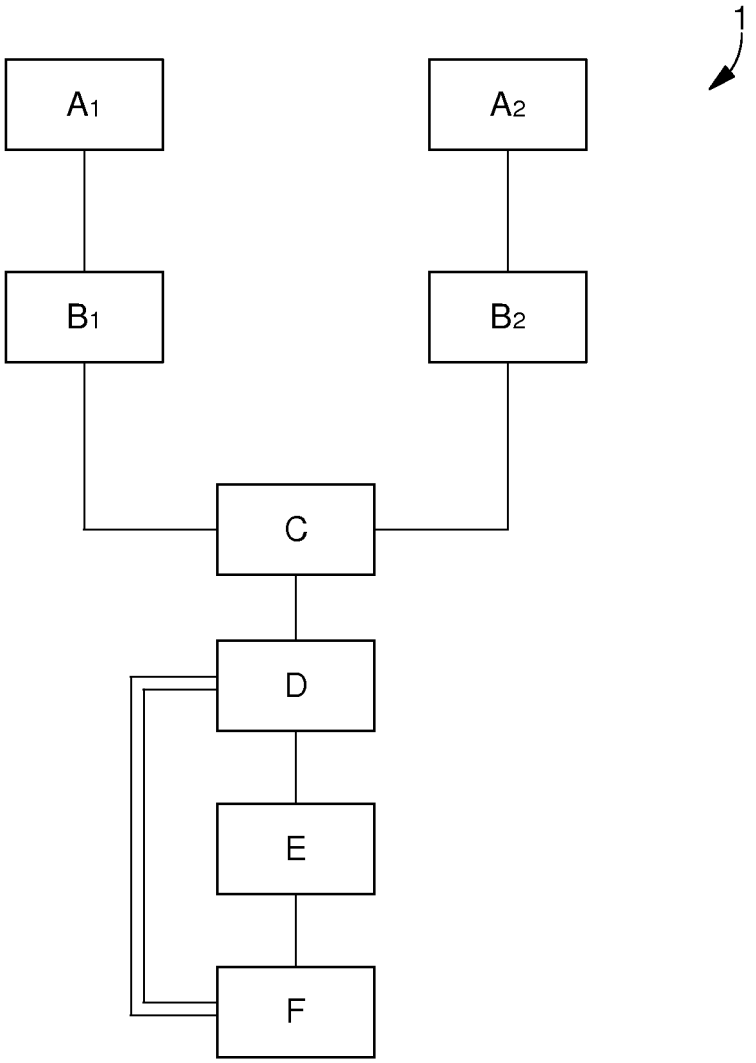
1
A1
A2
B1
B2
C
D
E
F

METHOD OF MANUFACTURING A WATCH PLATE

CROSS REFERENCE TO RELATED APPLICATION

This is a National Phase Application in the United States of International Patent Application PCT/EP2009/063782 filed Oct. 21, 2009, which claims priority on European Patent Application No. 08167196.8 of Oct. 21, 2008. The entire disclosures of the above patent applications are hereby incorporated by reference.

The present invention concerns a method of making a timepiece element.

BACKGROUND OF THE INVENTION

Watch plates made of crystalline materials are known in the prior art. These watch plates are fixed inside the watch case and support numerous elements. Among the elements supported by said plate are the bridges and various members of the movement, such as the gears. These plates have an extremely complex geometry and have to be very precise. Thus, in order to make this part easy to machine, brass is generally used.

However, the major drawback of this requirement for extreme precision is a very high manufacturing cost. This requires machining techniques and particularly the use of digitally controlled machining centres of high quality in order to satisfy the desired precision, and a very large number of steps.

Manufacturing costs are further increased by adding the most prestigious surface decorations to the movements. These decorations, such as satin finish, polishing and engine-turning are often made on the plate in order to give it a more attractive appearance while increasing its value. Of course, these aesthetic improvements require specialised machines, the cost of which is considerable.

SUMMARY OF THE INVENTION

The invention concerns a method of manufacturing a timepiece element which overcomes the aforementioned drawbacks of the prior art by proposing a less expensive plate which can be produced more quickly, yet has a precision at least equal to that of the prior art.

The invention therefore concerns an aforementioned method of making a watch plate, which is characterized in that it includes the following steps:

a) taking the material forming the plate including at least one metallic element;
b) forming said plate;
c) cooling everything so as to obtain said timepiece plate in an at least partially amorphous state; and
d) retrieving said plate.

In a first embodiment, the method uses the advantageous shaping properties of amorphous materials by applying a simple forging method. In fact, these amorphous metals have the peculiar characteristic of softening while remaining amorphous within a given temperature range [Tg–Tx] particular to each alloy (Tg: the vitreous transition temperature and Tx: the crystallisation temperature). It is therefore possible to shape such metals under low stress, on the order of the megapascal (MPa), and at low temperatures that may be as low as at least 200° C. depending upon the material. This then means that fine and precise geometries can be very precisely reproduced, since the viscosity of the alloy is greatly decreased, allowing it to mould to all the details of the dies. This is typically suitable for a complex and precise part such as a watch plate.

The invention also concerns a second embodiment which uses the principle of casting.

One advantage of this embodiment is that it is simpler to achieve and does not require the use of an amorphous preform. Indeed, this method uses simple techniques for making parts by casting, thereby requiring the use of less complex tools associated with the use of the amorphous area of said material. As for the first embodiment, this then means that fine and precise geometries can be precisely reproduced, since the viscosity of the alloy is greatly decreased and the latter then moulds to all of the details of the mould. This simplification leads to a sizeable financial saving.

Advantageous embodiments of this method form the subject of the dependent claims 29 to 74.

Another advantage follows from this capacity to match the shapes of the mould perfectly. Indeed, the plate manufacturing steps can thus be combined with the decoration steps at the same time. It is possible to envisage this solution by making the decorations straight onto the mould or dies so as to reproduce them straight away during manufacture of the plate. This again saves time and money.

Finally, the use of amorphous materials allows more resistant alloys with high mechanical performance to be employed. Thus, manufacture of the plate is no longer subject to brass machining. It is thus clear that by using materials with high mechanical performance, it also becomes possible to reduce the dimensions of said plate, particularly the thickness thereof, with the same mechanical features.

The present invention also concerns a method of making a timepiece bridge. Advantageous embodiments of this method form the subject of the dependent claims 3 to 26.

BRIEF DESCRIPTION OF THE DRAWINGS

The objects, advantages and features of the method according to the present invention will appear more clearly in the following detailed description of embodiments of the invention given solely by way of non-limiting example and illustrated by the single annexed drawing showing a flow chart of the method according to the invention.

DETAILED DESCRIPTION

A watch movement is formed of a plate on which the watch mechanism is fixed. Thus the plate supports the energy accumulating members, the regulating members and the motor members of said movement.

In the case of a mechanical watch, these various members can be secured between the plate and bridges via pivots. The present invention consists of a method 1 of manufacturing elements, such as a bridge or plate for a timepiece. In the following description, the manufacture of a plate will be taken by way of example, since watch bridges are made in an identical manner.

A first embodiment consists in using hot shaping via a press.

The first step $A_1$ consists first of all in making the dies for the plate. The dies each have an inner face including the negative pattern cavity of the plate to be manufactured. The dies are provided with means for evacuating any surplus material. Of course, since manufacture of these dies does not form part of the subject of the present invention, any possible methods for making the dies may be envisaged.

Secondly, this first step $A_1$ consists in taking the material in which the plate will be made. According to the present invention, the material used is an at least partially amorphous material. Preferably, a totally amorphous material will be used. Said material may or may not then be a precious metal. Of course, the metal could also be an alloy.

The use of amorphous material advantageously allows the dimensions to be reduced. Amorphous materials have deformation and elastic limit characteristics that enable them to undergo higher stresses before being plastically deformed. Thus, a reduction in dimensions, and particularly in thickness, can be envisaged for the same stress relative to a plate made of crystalline material.

Once the dies and material are available, the following step $B_1$ consists in handling everything to form said element.

First of all, step $B_1$ consists in making a preform of amorphous material. This preform consists of a part with a similar appearance and size to the final part. For example, in the present case of a plate, the preform takes the form of a disc. Said preform must thus always have an amorphous structure.

First, the dies are arranged in the hot press. The dies are then heated until they reach the material-specific temperature, preferably between the vitreous transition temperature Tg and crystallization temperature Tx.

Once the dies have reached the temperature, the preform is arranged on one of the dies. Pressure is then exerted on the preform by moving the dies closer together in order to replicate their shape on said amorphous metal preform. This pressing operation is carried out for a predetermined period of time. Once this time period has elapsed, the dies are opened so that step C of cooling the moulded part can begin.

This hot shaping method advantageously offers a high level of precision for the parts obtained. This precision is permitted by keeping the amorphous metal material at a temperature between Tg and Tx. In fact, when an amorphous material is heated to this temperature interval, the viscosity thereof is greatly decreased, changing, for some materials, from $10^{20}$ $Pa \cdot s^{-1}$ to $10^5$ $Pa \cdot s^{-1}$. This then allows the amorphous material to fill the spaces of said negative pattern cavities of each die better, which facilitates the manufacture of complex parts.

According to a second embodiment, the plate is made by casting, such as, for example, pouring a liquid metal into a mould. To achieve this, step $A_2$ consists first of all in making the mould for the plate by any possible method.

Secondly, this first step consists in taking the material in which the plate will be made. In this second embodiment, it is not essential to use an amorphous material. In fact, it does not matter whether the material is crystalline or already amorphous since the casting principle requires the material to be placed in liquid form, i.e. at a higher temperature than Tx. It is not, therefore, necessary to have a particular crystalline structure beforehand, since placing the material in a liquid state will unstructure said material.

However, since the melting temperature of amorphous metals is lower than that of crystalline metals, the method is thus easier to implement. The casting could also be by injection, allowing the liquid material to better match the shapes of the mould.

Then comes step $B_2$ of shaping the material. To achieve this, the material forming the plate is thus heated to be placed in liquid form. Once liquefied, the material is injected into the mould.

Once the predetermined pressing time is over, whether the dies are open or not, according to the first embodiment $A_1$, $B_1$ or the material has been cast according to the second embodiment $A_2$, $B_2$, the next step consists in solidifying said element. This solidification consists in a cooling step called step C. Step C is performed quickly to bring the temperature down as quickly as possible to less than Tg. Indeed, if the cooling is too slow, this allows the atoms to be structured in a cell and thus the metal to crystallise, whereas quick cooling solidifies the atoms to prevent them from being structured. Thus, although in the case of hot forming, the object is to preserve the at least partially amorphous initial state, in the case of pouring, the object is to obtain an amorphous or at least partially amorphous state.

Indeed, in the second embodiment, the use of metal casting then cooling step C to make the metal amorphous is more precise than the crystalline metal equivalent. Since amorphous metal does not have a crystalline structure when it solidifies, the amorphous metal experiences very few material shrinkage effects due to solidification. Thus, in the case of a crystalline material, solidification shrinkage can be up to 5 or 6%, which means that the size of the part will be decreased by 5 or 6% during solidification. In the case of amorphous metal, this shrinkage is around 0.5%.

The fourth step D then consists in retrieving said plate once it has solidified.

Advantageously according to method 1, a step E is provided after step D. Step E consists in inserting complementary members in the plate such as ruby bearings, used, for example, for carrying the arbours of toothed wheels forming the gear of the watch. Preferably, the ruby bearings are inserted in step E by hot setting. To achieve this, the plate is heated locally at the place where said bearing has to be inserted, to a temperature comprised between Tg and Tx. Once the place of insertion has reached the temperature, the ruby bearing is moved towards said place and then pushed into the plate.

In a first variant of this step E, the bearing is heated to a higher temperature than Tg, and then pressed into the plate. The heat released by said bearing heats the plate locally to a higher temperature than Tg which facilitates the insertion.

Next, the plate is cooled quickly to preserve the amorphous state of the metal and is deburred of any surplus material. This step E thus fixes the bearing more securely in the plate because of the capacity of the amorphous material to mould to the contours. The simplicity of step E also saves time and money.

In a second variant, the bearing could be placed straight into the mould or on the dies and inserted during steps $B_1$ or $B_2$.

In a third variant, the bearings may advantageously be integrated straight in the cast or die cast shape during steps $B_1$ or $B_2$ thereby forming a single piece element, i.e. the bearings form an integral part of the element and not an added part.

Advantageously, method 1 may also provide a step F of re-crystallising said plate. To achieve this, the plate is heated to a temperature at least equal to the crystallisation temperature of the amorphous metal. Cooling is then carried out so that the atoms have time to be structured. This step may take place after retrieval step D (in double lines in FIG. 1) or after step E of inserting complementary members (in a single line in FIG. 1). This re-crystallisation may advantageously be used to modify certain physical, mechanical or chemical properties of the material, such as toughness, hardness or friction coefficient.

A variant of method 1 consists in making decorations during step $B_1$ or $B_2$ of the above embodiments. To achieve this, the plate decorations such as côte de Genève engraving, circular graining, satin finish or engine-turning are made directly in the negative pattern cavities of said mould or said dies. Thus, in addition to the aforecited advantages, this variant also means that the heavy tools currently used for the series manufacture of these decorations are no longer necessary. It is clear that method 1 thus allows a decorated plate to be made more quickly and, incidentally, less expensively.

Moreover, a screw thread could be made directly during step $B_2$ of the second embodiment. This operation would then be carried out during casting by inserts provided in the mould.

It will be clear that various modifications and/or improvements and/or combinations evident to those skilled in the art may be made to the various embodiments of the invention set out above without departing from the scope of the invention defined by the annexed claims.

It will be clear that the plate may be square or rectangular and that the ruby bearings are not the only complementary members that can be inserted.

What is claimed is:

1. A method of making a timepiece plate, comprising the following steps:

a) obtaining material including at least one metallic element;

b) forming said plate from the material;

c) cooling the material so as to obtain said timepiece plate in an at least partially amorphous state; and d) retrieving said plate;

e) inserting at least one complementary member in the plate by hot setting.

2. A method of making a timepiece bridge, comprising the following steps:

a) obtaining material forming including at least one metallic element;

b) forming said bridge from the material;

c) cooling the material so as to obtain said timepiece bridge in an at least partially amorphous state;

d) retrieving said bridge; and e) inserting at least one complementary member in said bridge by hot setting.

3. The method according to claim 1, wherein step b) includes the following steps:

making an at least partially amorphous preform;

heating dies between the vitreous transition temperature and the crystallisation temperature of the material;

placing the preform between the dies; and exerting pressure on the preform using the dies for a predetermined time so as to replicate the shape thereof on each of the faces of the preform, and wherein step c) includes cooling said plate so as to preserve the at least partially amorphous state thereof.

4. The method according to claim 2, wherein step b) includes the following steps:

making an at least partially amorphous preform;

heating dies between the vitreous transition temperature and the crystallisation temperature of the material;

placing the preform between the dies; and exerting pressure on the preform using the dies for a predetermined time so as to replicate the shape thereof on each of the faces of the preform, and wherein step c) includes cooling said bridge so as to preserve the at least partially amorphous state thereof.

5. The method according to claim 3, wherein the dies include inserts.

6. The method according to claim 4, wherein the dies include inserts.

7. The method according to claim 5, wherein each insert forms a shape in the plate.

8. The method according to claim 6, wherein each insert forms a shape in the bridge.

9. The method according to claim 7, wherein said shape is a bearing.

10. The method according to claim 8, wherein said shape is a bearing.

11. The method according to claim 7, wherein said shape is a decoration.

12. The method according to claim 8, wherein said shape is a decoration.

13. The method according to claim 5, wherein each insert forms a member to be integrated in the plate.

14. The method according to claim 6, wherein each insert forms a member to be integrated in the bridge.

15. The method according to claim 13, wherein said member is a bearing.

16. The method according to claim 14, wherein said member is a bearing.

17. The method according to claim 13, wherein said member is a decoration.

18. The method according to claim 14, wherein said member is a decoration.

19. The method according to claim 1, wherein step b) includes making said plate by pouring said material into a mould, and step c) includes cooling everything so as to give said element an amorphous structure.

20. The method according to claim 2, wherein step b) includes making said bridge by pouring said material into a mould, and step c) includes in cooling everything so as to give said element an amorphous structure.

21. The method according to claim 19, wherein the cast moulding is injection moulding.

22. The method according to claim 20, wherein the cast moulding is injection moulding.

23. The method according to claim 19, wherein the mould includes inserts.

24. The method according to claim 20, wherein the mould includes inserts.

25. The method according to claim 23, wherein each insert makes a shape in the plate.

26. The method according to claim 24, wherein each insert makes a shape in the bridge.

27. The method according to claim 25, wherein said shape is a thread.

28. The method according to claim 26, wherein said shape is a thread.

29. The method according to claim 25, wherein said shape is a bearing.

30. The method according to claim 26, wherein said shape is a bearing.

31. The method according to claim 25, wherein said shape is a decoration.

32. The method according to claim 26, wherein said shape is a decoration.

33. The method according to claim 23, wherein each insert forms a member intended to be integrated in said plate.

34. The method according to claim 24, wherein each insert forms a member intended to be integrated in said bridge.

35. The method according to claim 33, wherein said member is a bearing.

36. The method according to claim 34, wherein said member is a bearing.

37. The method according to claim 33, wherein said member is a decoration.

38. The method according to claim 34, wherein said member is a decoration.

39. The method according to claim 1, wherein the insertion step e) includes the following steps:

heating the surface of the plate that will receive the member to a temperature comprised between the vitreous transition temperature and crystallisation temperature thereof; and exerting pressure on said member so that the latter is inserted into said plate.

40. The method according to claim 2, wherein the insertion step e) includes the following steps:

heating the surface of the bridge that will receive the member to a temperature comprised between the vitreous transition temperature and crystallisation temperature thereof; and exerting pressure on said member so that the latter is inserted into said bridge.

41. The method according to claim 1, wherein the insertion step e) includes the following steps:

heating the member that is to be received on the surface of the plate to a higher temperature than the vitreous transition temperature; and exerting pressure on said member so that the latter is inserted into said element.

42. The method according to claim 2, wherein the insertion step e) includes the following steps:

heating the member that is to be received on the surface of the bridge to a higher temperature than the vitreous transition temperature; and exerting pressure on said member so that the latter is inserted into said element.

43. The method according to claim 1, wherein said at least one complementary member includes a ruby bearing.

44. The method according to claim 2, wherein said at least one complementary member includes a ruby bearing.

45. The method according to claim 1, wherein the method further includes the step consisting in crystallising the plate.

46. The method according to claim 2, wherein the method further includes the step consisting in crystallising the bridge.

47. The method according to claim 1, wherein the material used is totally amorphous.

48. The method according to claim 2, wherein the material used is totally amorphous.

* * * * *